US006293219B1

(12) United States Patent
Paradis

(10) Patent No.: US 6,293,219 B1
(45) Date of Patent: Sep. 25, 2001

(54) SUSPENSION SYSTEM FOR INFLATABLE BOAT

(76) Inventor: John B Paradis, 4624 Guam St., VaBch, VA (US) 23455

( * ) Notice: Subject to any disclaimer, the term of this patent is extended or adjusted under 35 U.S.C. 154(b) by 0 days.

(21) Appl. No.: 09/398,713

(22) Filed: Sep. 20, 1999

(51) Int. Cl.[7] ..... B63C 9/02

(52) U.S. Cl. ..... 114/348; 441/40; 114/377; 414/137.1

(58) Field of Search ..... 441/40, 43; 114/348, 114/345, 365, 366, 368, 376, 377; 414/137.1, 137.7, 137.8, 137.9

(56) References Cited

U.S. PATENT DOCUMENTS 5,018,475 * 5/1991 Burke ..... 114/365

FOREIGN PATENT DOCUMENTS

521016 * 2/1932 (DE) ..... 441/40

* cited by examiner

*Primary Examiner*—Jesus D. Sotelo

(57) ABSTRACT

A rigid structural pallet is provided to support and carry cargo suspended by a crane or helicopter for delivery into or recovery from the water. The pallet consists of a rigid panel extending the full longitudinal and lateral (horizontal) extent of the pallet, one or more longitudinal rails, and a single suspension ring attached to the longitudinal rail or rails carrying the full weight of the cargo and pallet.

2 Claims, 2 Drawing Sheets

SUSPENSION SYSTEM FOR INFLATABLE BOAT

BACKGROUND OF THE INVENTION

The US military, particularly the US Navy, US Marine Corps, and the US Special Operations Forces, has a well-established requirement to conduct expeditionary warfare operations from the seaward approaches to an objective. Among other resources, helicopters and inflatable boats are critical assets routinely employed during these operations. A helicopter-borne approach to a coastline, launched from ships at sea, delivering small inflatable boats for the final insertion onto the beach is the usual methodology utilized to initiate pre-invasion operations such as shore and landing-zone reconnaisance, beach obstacle clearance, etc.

A variety of techniques have been developed to transport these inflatable boats by helicopter. The objectives of these techniques include rapid airborne approach, quick launch of the boat, equipment and personnel followed by immediate withdrawal of the helicopter. These objectives have been imperfectly achieved, particularly for operations conducted from US Navy ships utilizing US Navy helicopters (platforms constrained by other requirements).

Various solutions have been adopted, including internal carriage of a deflated boat along with the personnel and mission equipment (requiring extended periods in hover while the boat and equipment are lowered into the water and assembled), use of US Army or Air Force helicopters on US Navy vessels (with concomitant interservice supportability and interoperability problems), the use of long tethers or nets (or both) suspended below the helicopter, delivery of limited amounts and types of equipment and personnel by parachute, etc.

SUMMARY OF THE INVENTION

The invention provides a substantial improvement in the current methods used for this kind of operation, by providing a cargo pallet to carry a full mission loadout of equipment including the inflatable boat externally (but close-coupled) to the helicopter, in a manner that allows the helicopter to drop the cargo and boat into the water and depart immediately. This pallet consists of a horizontal deck supported by 1 or more longitudinal members, which carry the cargo-induced loads to a single-point suspension located near the center of the pallet. The usual method of employing the pallet is to load the cargo onto the deck of the pallet after it has been inserted into a surrounding inflated boat; this assembly is attached to the cargo hook of a helicopter or picked up by a crane for placement into the water.

OBJECTIVES OF THE INVENTION

An objective of the invention is to overcome the aforementioned difficulties associated with prior techniques for transporting and inserting a small inflatable boat and its mission cargo by helicopter.

Another objective is to provide a simplified method for launching or recovering a small inflatable boat and its mission cargo from a ship at sea.

A further objective of the invention is to provide structural foundations for mounting antennas, weapons, etc to the cargo pallet installed in an inflatable boat.

DESCRIPTION OF THE PREFERRED EMBODIMENTS

Figure 1:
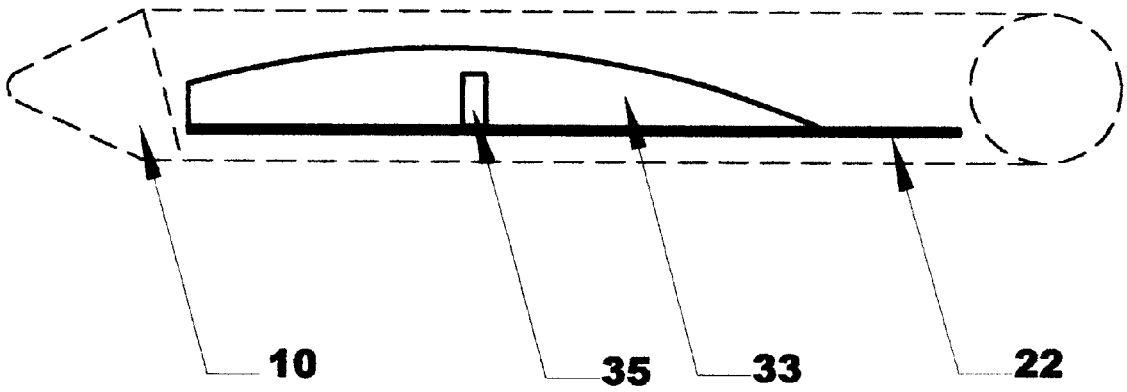
FIG. 1 is an isometric view of the pallet assembly installed in an inflatable boat, illustrating one embodiment of the invention.
Figure 2:
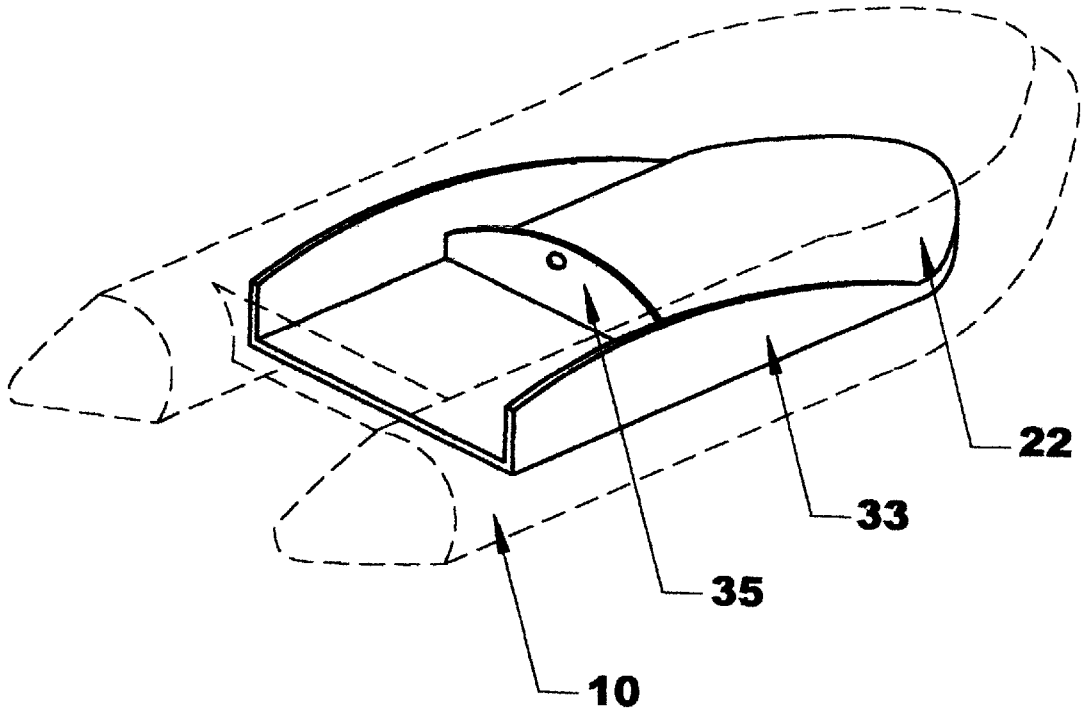
FIG. 2 is a side cutaway view of the pallet installed in an inflatable boat, with the port hull removed for clarity, to illustrate one embodiment of the invention, including a longitudinal member attached to the horizontal panel, and a suspension ring.

FIG. 1 is an isometric illustration, which shows some elements that are common to all the embodiments described elsewhere in this document and in FIG. 2.

FIG. 2 illustrates an embodiment of a suspension frame in an inflatable boat 10, with a rigid horizontal panel 22 with an extension 34 under the bow of the inflatable boat, an attached longitudinal rail 33, and a single-point suspension ring 35.

One embodiment of the pallet employs a single longitudinal rail 33 located along the longitudinal centerline of the pallet, with the suspension ring 35 attached to the top of the rail. Another embodiment locates a pair of rails 33 along the sides of the horizontal panel 22 with the suspension ring 35 attached by way of a transverse extension of the ring to these longitudinal rails.

OPERATION OF THE INVENTION

In all embodiments, the pallet, consisting of one or more rigid longitudinal members with a single lift point assembly, attaches to a horizontal panel that fits into an inflatable boat. It is important to all embodiments that the pallet provides the capability to support itself, the superimposed cargo, and the inflatable boat while suspended by a single lift point.

The attachment of the longitudinal rails to the horizontal panel may be permanent or removable, attached by rivets, bolts, other mechanical devices, or may wrap around the edge of the horizontal panel.

The longitudinal rails constrain the horizontal panel such that it remains planar under the forces induced by the cargo, the suspension ring, and other forces such as helicopter aerodynamic loads, overridden waves, etc.

Many modifications, variations and applications of the present invention are possible in the light of the above teachings. It is therefore to be understood that within the scope of the appended claims the invention may be practiced otherwise than as specifically described.

What is claimed is:

1. An integral cargo-carrying pallet comprising a cargo-supporting means provided with a single lift ring and mounting means for mounting the cargo-carrying pallet in an inflatable boat.

2. The cargo-carrying pallet of claim 1, wherein the cargo-supporting means comprises separable elements including a horizontal panel, at least one longitudinal rail, and wherein the single lift ring comprises a suspension lift ring assembly.

* * * * *